US011274401B2

(12) United States Patent
Bötzius et al.

(10) Patent No.: US 11,274,401 B2
(45) Date of Patent: Mar. 15, 2022

(54) EARTH WORKING MACHINE

(71) Applicant: Wirtgen GmbH, Windhagen (DE)

(72) Inventors: Sebastian Bötzius, Siegburg (DE); Axel Mahlberg, Hennef (DE); Stefan Scheer, Asbach / Hussen (DE); Björn Buchholz, Cologne (DE)

(73) Assignee: Wirtgen GmbH

( * ) Notice: Subject to any disclaimer, the term of this patent is extended or adjusted under 35 U.S.C. 154(b) by 85 days.

(21) Appl. No.: 16/824,774

(22) Filed: Mar. 20, 2020

(65) Prior Publication Data

US 2020/0318297 A1 Oct. 8, 2020

(30) Foreign Application Priority Data

Apr. 3, 2019 (DE) ..... 10 2019 108 759.7

(51) Int. Cl.
*E01C 19/23* (2006.01)
*E01C 19/28* (2006.01)
(Continued)

(52) U.S. Cl.
CPC ..... *E01C 19/286* (2013.01); *E01C 19/236* (2013.01); *E01C 19/266* (2013.01); *E01C 23/088* (2013.01); *E01C 2301/30* (2013.01)

(58) Field of Classification Search
CPC .... E01C 19/236; E01C 19/266; E01C 19/286; E01C 23/088; E01C 2301/30
(Continued)

(56) References Cited

U.S. PATENT DOCUMENTS 508,157 A 11/1893 Wilson
1,104,502 A 7/1914 Hist
(Continued)

FOREIGN PATENT DOCUMENTS

CN 105714663 A 6/2016
CN 109162185 A 1/2019
(Continued)

OTHER PUBLICATIONS

Examination Report for corresponding DE 10 2019 108 759.7, dated Jan. 27, 2020, 5 pages (not prior art).
(Continued)

*Primary Examiner* — Raymond W Addie
(74) *Attorney, Agent, or Firm* — Lucian Wayne Beavers; Patterson Intellectual Property Law, PC

(57) ABSTRACT

An earth working machine (10), in particular a road milling machine, a stabilizer, or the like, having a milling drum (30) that is mounted rotatably on a machine frame (11) and is populated or populatable on its outer circumference with working tools (31); the working tools (31) to come into contact, during working operation, with the ground that is to be worked to remove it; a drive unit (20) drives the milling drum (30) by means of a drive motor (21); an input drive shaft (33) couplable to the drive motor (21) is attached to the milling drum (30); and a ballast element, constituting a kinetic mass (57), increases the kinetic energy of the milling drum (30). The kinetic mass (57) is couplable to or decouplable from the rotatable milling drum (30), or a rotational member indirectly or directly coupled to the milling drum (30), via a shiftable coupling (55).

22 Claims, 4 Drawing Sheets

(51) Int. Cl.
*E01C 19/26* (2006.01)
*E01C 23/088* (2006.01)

(58) Field of Classification Search
USPC ..... 404/84.05, 92–94, 117, 130
See application file for complete search history.

(56) References Cited

U.S. PATENT DOCUMENTS

| | | | | |
|---|---|---|---|---|
| 1,538,550 | A | 5/1925 | Hamilton | |
| 2,559,427 | A | 7/1951 | Hastings | |
| 3,008,389 | A | 11/1961 | Hicks | |
| 3,078,730 | A | 2/1963 | Clements | |
| 3,238,799 | A * | 3/1966 | Baker | B07B 1/42 74/87 |
| 4,006,936 | A | 2/1977 | Crabiel | |
| 5,846,176 | A | 12/1998 | Zieger et al. | |
| 7,540,689 | B1 * | 6/2009 | Major, Sr. | E01C 19/266 172/611 |
| 7,644,994 | B2 * | 1/2010 | Busley | E01C 23/088 299/39.4 |
| 10,774,482 | B2 | 9/2020 | Mahlberg et al. | |
| 2002/0192025 | A1 | 12/2002 | Johnson | |
| 2016/0177520 | A1 | 6/2016 | Mahlberg et al. | |
| 2019/0153681 | A1 * | 5/2019 | Christian | E01C 11/005 |

FOREIGN PATENT DOCUMENTS

| | | | |
|---|---|---|---|
| DE | 19547698 | A1 | 6/1997 |
| DE | 20122928 | U1 | 5/2010 |
| DE | 102014118802 | A1 | 6/2016 |
| EP | 2354310 | A2 | 8/2011 |
| GB | 11560 | | 9/1904 |

OTHER PUBLICATIONS

China Office Action for the corresponding Chinese Patent Application No. 20201 0227829.0, dated Jun. 17, 2021, 6 pages (not prior art).

* cited by examiner

EARTH WORKING MACHINE

BACKGROUND OF THE INVENTION

1. Field of the Invention

The invention relates to an earth working machine, in particular a road milling machine, a stabilizer, or the like, having a milling drum that is mounted rotatably on a machine frame and is populated or populatable on its outer circumference with working tools; the working tools being provided so as to come into contact, during working operation, with the ground that is to be worked in order to remove it; a drive unit being provided which drives the milling drum by means of a drive motor; an input drive shaft that is couplable to the drive motor being attached to the milling drum; and a ballast element, constituting a kinetic mass, being provided in order to increase the kinetic energy of the milling drum.

2. Description of the Prior Art

Earth working machines are known in a wide variety of embodiments. For example, DE 20 122 928 U1 discloses a road milling machine constituting an earth working machine. It comprises a drive train. The latter encompasses a drive motor, a shift coupling, and a transmission (the so-called milling drum transmission), as well as devices intermediating between those units, in particular shafts or toothed or endless drives.

DE 20 122 928 U1 discloses the use of a milling drum that is populated on the surface of its milling-drum tube with working tools. "Working tools" are understood for purposes of the invention in particular as constituents of the milling drum which functionally interact with the milled material during the working process. They are, for example, the milling bits with which the substrate is milled off, and/or ejector tools that perform a directing and conveying function for the milled material.

When a machine according to the present invention is used, the working result is critically influenced by the rotation speed of the milling drum. The optimum rotation speed generally depends on the application. For precision milling of road surfaces with a shallow milling depth in order to reestablish traction, relatively higher rotation speeds are needed on order to generate a uniform milling pattern. Only superficial working is therefore performed here.

Lower rotation speeds tend to be more favorable when entire or multiple layers of the road structure are being removed, since it has been found that fewer fines and therefore reduced dust emission can be ensured. In addition, wear on the milling tools is greatly reduced at low rotation speeds. A reduced milling drum rotation speed also requires less drive power to the milling drum, which results in lower fuel consumption for the same advance speed. On the other hand, the advance speed can also be increased and can thereby make possible greater removal performance. All in all, a minimum possible milling drum rotation speed is therefore desirable for such applications.

In order to meet the various requirements, it is therefore known to allow the milling drum rotation speed to be adjusted variably in the context of road milling. If the rotation speed selected is too low, however, the kinetic energy of the milling drum is no longer sufficient for effective working of the milled material, and out-of-round, uneven running of the milling drum occurs, with consequences including vibration of the entire earth working machine or even rocking of the machine. Damage to the machine can also occur. In addition, uneven running of the milling drum impairs working quality, and irregularities in the milling pattern can occur. In extreme cases the milling drum can become stuck if there is insufficient kinetic energy.

Heavy weight in the context of an earth working machine contributes to increased smoothness even at low rotation speeds. This is disadvantageous in many ways, however, since special requirements in terms of transport then arise (large milling machines over 40 tonnes constitute "overweight" loads), and utilization capabilities on substrates having little load-carrying capability become restricted.

It is therefore known to ballast milling machines for stabilization. Additional weights are fastened onto the machine for that purpose. In the context of a road milling machine of approximately 4.5 tonnes gross weight, for example, it is known to make 1.3 tonnes available by way of additional weights. In other words, the additional weights account for almost one-third of the machine weight. A machine of this kind is thus versatile, but must be ballasted with heavy additional weights for optimum adaptation to the particular task.

U.S. Pat. No. 4,006,936 A discloses an earth working machine having a milling device. In order to improve the smooth running of the milling drum, it is recommended to use a milling drum tube that has a greater wall thickness than usual milling drum tubes. This procedure proves disadvantageous especially in terms of manufacture, since milling drums tubes are rolled up from a flat cut-out piece. The rolled piece is then welded at its longitudinal-side abutting points. The tube that has thereby been produced and welded must then be surface-machined. The large material thickness considerably increases production outlay. The use of the thicker cut-out piece requires a considerable increase in shaping outlay. Because of the thick wall, the milling drum tube can only be produced considerably out-of-round, so that increased material removal is required in the context of surface machining. In addition, flexible adaptation to the particular task cannot be implemented with this embodiment of the milling drum tube.

DE 10 2014 118 802 A1 discloses a road milling machine in which a milling drum is drivable via a drive train. The drive train encompasses in particular a drive motor, a shiftable coupling, and a transmission (the so-called milling drum transmission). DE 10 2014 118 802 A1 proposes to replaceably attach to the drive train or to the milling drum a ballast weight, constituting a kinetic mass, in order to increase the kinetic energy. The milling drum comprises for that purpose, for example, pocket-shaped receptacles into which ballast weights can be slid. With this road milling machine, the recognition that a more smoothly running milling drum can be achieved if the kinetic energy in the drive train and/or the milling drum is increased is utilized. The kinetic energy is calculated according to the formula:

$$E_{rot}=\tfrac{1}{2}mr^2\omega^2,$$

in which m indicates the magnitude of the rotating mass and r the distance of that mass from the rotation axis. The product $mr^2$ represents the so-called moment of inertia of the moving mass, and ω the angular velocity (2π*rotation speed).

Since a reduction is rotation speed is desired, as described above, the objective pursued with the replaceable ballast weights is an elevation in moment of inertia, for which purpose those ballast weights are installed on the rotating parts of the drive train or of the milling drum.

With the replaceable ballast weights, the milling drum can be individually adapted to the particular working task at hand. A certain installation outlay is necessary here for adaptation, however. In addition, the ballast weights stress the drive motor and the coupling or the milling transmission, especially when the machine is starting up.

SUMMARY OF THE INVENTION

The object of the invention is to furnish an earth working machine of the kind mentioned initially which can be adapted in simple fashion to different milling applications and which is notable for smooth running simultaneously with low stress on the drive train.

This object is achieved in that the kinetic mass is couplable to or decouplable from the rotatable milling drum, or a rotational member indirectly or directly coupled to the milling drum, via a shiftable coupling.

As the machine operator desires, the kinetic mass can either be coupled onto the milling drum or decoupled therefrom via the shiftable coupling. In the decoupled state, the earth working machine is optimally designed for standard operation. If a change is then made from that standard operating mode to lower rotation speeds, the machine operator can conveniently engage the kinetic mass via the shiftable coupling in order thereby to carry out an adaptation of the machine. Complex installation operations for adapting the machine can be avoided. Provision can be made in particular that the kinetic mass is coupled onto the input drive shaft or the bearing shaft only once the milling drum is already in rotational operation. The milling drum can thereby be started up without an engaged kinetic mass. The kinetic mass accordingly does not stress the drive train, in particular the drive motor, the shiftable transmission, or a shift coupling connecting the drive motor and the shiftable transmission, with its dead weight. The service life of the components of the drive train is extended by this simple measure.

Under otherwise identical conditions, engagement of the kinetic mass can produce a reduction in the rotation speed during operational use, simultaneously with an increase in moment of inertia. The reduction in milling drum rotation speed is accompanied by a decrease in the power consumption requirement, which results in a decrease in the fuel consumption and emissions of the drive motor. Lower rotation speeds are then also accompanied by decreased bit wear and lower coolant consumption.

According to a preferred embodiment of the invention, provision can be made that the input drive shaft, or a bearing shaft which is arranged oppositely from the input drive shaft and by means of which the milling drum is mounted on a machine frame, constitutes the rotational member. Little design outlay is required for coupling the kinetic mass to the input drive shaft or bearing shaft. In particular, sufficient installation space is usually available at those locations to enable integration of the kinetic mass and the shiftable coupling.

It is also conceivable for the kinetic mass to be exchangeable. It can then, in particular, be replaced with another kinetic mass having a different weight. This makes it possible to allow adaptation of the milling drum to any application situation. It is generally sufficient, however, if a suitable kinetic mass is available which is suitably dimensioned to allow coverage of a broad application spectrum.

According to a preferred variant embodiment of the invention, provision can be made that the kinetic mass is coupled to the rotational member or to the milling drum through the intermediary of a conversion transmission; and that the conversion transmission converts the rotation speed at which the milling drum or the rotational member rotates to a higher rotation speed at which the kinetic mass rotates. It is also conceivable in this context, in particular, for the conversion transmission to be embodied as a shiftable transmission having two or several conversion ratio steps, or to be embodied as a transmission in which the conversion ratio is embodied in steplessly modifiable fashion. A variation in rotation speed can thereby be effected in different steps (or steplessly). It is thus possible to modify the rotation speed at which the kinetic mass rotates, in order to modify the moment of inertia acting at the milling drum and thereby to allow implementation of a further adaptation to individual working requirements.

It is conceivable in the context of the invention for the bearing shaft or the input drive shaft of the milling drum to be guided directly to the input drive side of the conversion transmission. Minimal physical complexity is thereby offered. It is also conceivable, however, for the bearing shaft or the input drive shaft to be guided indirectly to the input drive side of the conversion transmission through the intermediary of at least one rotary member.

A particularly preferred variant of the invention is one such that the output drive side of the conversion transmission is connected via the coupling to the kinetic mass. At that point the kinetic mass can be coupled and decoupled in simple fashion with little design outlay. In addition, the rotating parts of the conversion transmission also contribute, to a certain extent, to increased kinetic energy and to stabilization of milling operation even when the kinetic mass is decoupled.

It is also conceivable for the shiftable coupling to be arranged between the bearing shaft and the input side of the conversion transmission. Both the conversion transmission and the kinetic mass can thus be simultaneously decoupled when the coupling is engaged. The conversion transmission is not operated in the decoupled state, representing a feature to optimize wear.

If a road milling machine is utilized as an earth working machine, provision can particularly preferably be made according to the present invention that the milling drum at a rotation speed in the range between 30 and 240 revolutions per minute, and the kinetic mass at a rotation speed in the range between 60 and 4000 revolutions per minute. Particularly preferably, the rotation speed of the kinetic mass is selected to be in the range between 1000 and 4000 revolutions per minute. This preferred range is suitable in particular for use in road milling machines, since smooth running can be achieved here with a relatively small kinetic mass.

For milling applications in which at least one layer of the roadway covering of a road must be removed, it has been found that the dimensioning is advantageously implemented in such a way that the moment of inertia of the milling drum has a first value when the coupling is disengaged; and that the moment of inertia of the constituent receiving the milling drum and the kinetic mass has a second value when the coupling is engaged, the second value being at least twice as great as the first value.

Reliable compensation for imbalances in road milling applications can be achieved when provision is made that the moment of inertia of the kinetic mass is greater than or equal to $T/i^2$, where T corresponds to the moment of inertia of the milling drum and i is the rotation speed ratio between the rotation speed of the kinetic mass and the rotation speed of the milling drum. It is immediately apparent that a greater effective moment of inertia on the drive side can be generated for a higher rotation speed, since the latter value is squared.

This correlation is also evident from the formula below:

$$T_{effective\ milling\ drum}=(T_{kinetic\ mass}*i^2)+T_{milling\ drum}.$$

The moment of inertia acting at the milling drum corresponds to the moment of inertia of the milling drum (as well as attachments that are present, e.g. parts of the drive train) plus the moment of inertia of the kinetic mass multiplied by the square of the rotation speed ratio i. An ideal transmission is assumed here in the interest of simplification.

What is stated in the preceding paragraph also follows directly therefrom when:

$$T_{kinetic\ mass}=T_{milling\ drum}/i^2,$$

yielding 2*T as the effective torque at the milling drum.

An earth working machine according to the present invention can be characterized in that the conversion transmission is arranged at least locally in the installation space enclosed by the milling drum. The conversion transmission is thereby accommodated in space-saving fashion. It is also conceivable, additionally or alternatively, for the conversion transmission to be received at least locally inside a milling drum housing. A design of this kind is recommended when sufficient installation space to enable integration of the conversion transmission is already available in the region of the milling drum housing. The conversion transmission can of course also be arranged at least locally inside the milling drum housing, simultaneously also projecting at least locally into the installation space surrounded by the milling drum.

That part of the conversion transmission which is located in the milling drum housing should then be protected, by way of suitable measures, from attack by the removed material present in the milling drum housing. When it is the case that the conversion transmission at least partly projects into the installation space surrounded by the milling drum, the milling drum geometry then protects the conversion transmission.

According to an inventive alternative, provision can also be made that the milling drum is received at least partly inside the milling drum housing, the bearing shaft being arranged in the region of a side wall of the milling drum housing; and that the conversion transmission is attached or arranged on the milling drum housing outside the internal space that receives the milling drum, preferably on the outer side of the milling drum housing, particularly preferably on the outer side of the side wall. A procedure of this kind is recommended when a sufficiently large installation space for the conversion transmission must be made available laterally on the milling drum housing. Because the conversion transmission is arranged outside the milling drum housing, it then of course no longer needs to be protected from removed material.

As has been described above, provision can be made for the use of a conversion transmission. The invention is not, however, limited thereto. It is instead also conceivable that when the coupling is in the engaged state, the milling drum is coupled to the kinetic mass in such a way that the rotation speed of the milling drum and the rotation speed at which the kinetic mass rotates correspond to one another, slippage of the coupling being disregarded.

A particularly space-saving design can be achieved if provision is made that the coupling and the kinetic mass are arranged inside the installation space surrounded by the milling drum.

It is also possible to use, in the context of the invention, a braking apparatus that is designed to decelerate the kinetic mass when the coupling is in the open state, i.e. when the kinetic mass is decoupled from the milling drum. This prevents the kinetic mass from being moved as a result of drag torques within the coupling (for example in viscous couplings).

As has been described above, the coupling can be arranged in the region between the conversion transmission and the kinetic mass. This has the advantage that a more economical coupling of weaker design can be utilized.

It is also conceivable, however, for the coupling to be arranged before the conversion transmission. When the coupling is disengaged, both the conversion transmission and the kinetic mass are accordingly decoupled from the milling drum. Since the conversion transmission then also no longer needs to be moved in this operating state, better efficiency then results.

According to an inventive variant, a monitoring device can also be provided which, with a detection unit, detects one or several machine states. For example, a vibration sensor, and/or a torque sensor that detects a torque in the region of the drive train, in particular at the drive motor, can be provided. It is furthermore conceivable for the machine weight that is loading the lifting columns of a road milling machine to be monitored. The monitoring signal detected by the detection unit is delivered to the monitoring device, where the monitoring signal is evaluated. If an impermissible deviation from a stipulated signal exists, a switching signal is generated by the monitoring device. Said signal causes opening of the shiftable coupling using a positioning element, for example a positioning drive. The result is then that, upon occurrence of an undesired machine state, the kinetic mass is decoupled from the milling drum by actuation of the shiftable coupling.

In the context of forward milling, for example, the risk exists that as a result of impermissible operating forces, the machine may be lifted out of cutting engagement and pulled forward. This is described, for example, in EP 2 354 310 A1. If the monitoring device should detect an undesired operating state, the shiftable coupling is then actuated and the kinetic mass is decoupled from the milling drum. The moment of inertia of the milling drum is thereby immediately reduced. Thanks to this reduction in moment of inertia, the milling drum comes to a halt or the drive motor becomes stalled, so that an undesired machine state can be suppressed.

BRIEF DESCRIPTION OF THE DRAWINGS

The invention will be explained in further detail below with reference to the exemplifying embodiments depicted in the drawings, in which.

DETAILED DESCRIPTION

Figure 1:
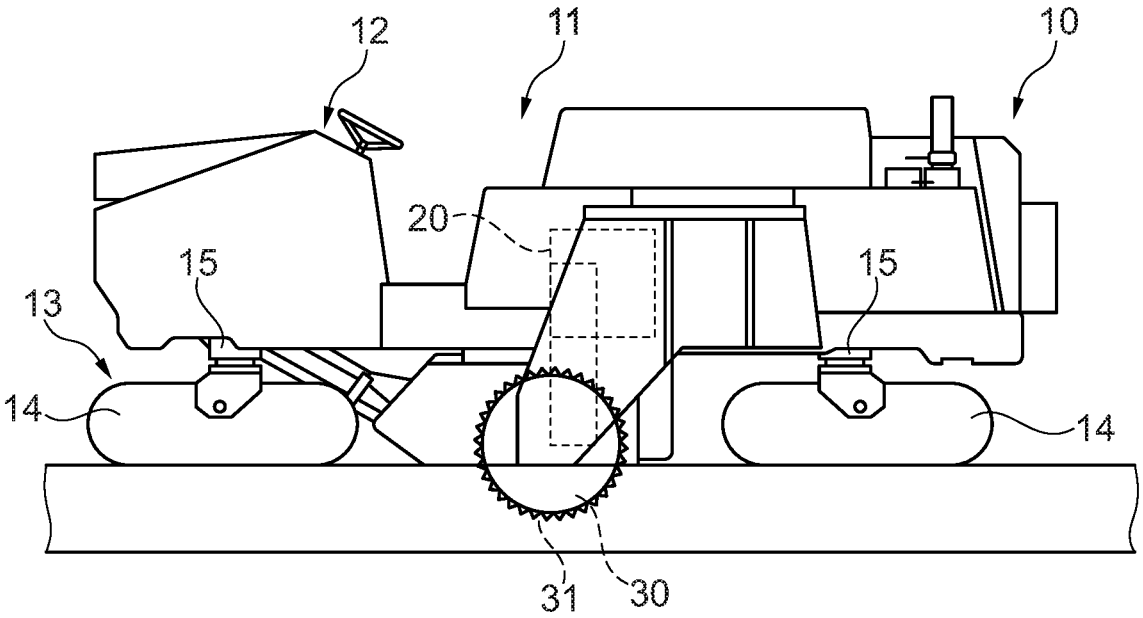
FIG. 1 is a side view of a large milling machine constituting an example of an earth working machine.

FIG. 1 shows, as an earth working machine, a road milling machine 10 for milling road surfaces made of asphalt, concrete, or the like. Road milling machine 10 comprises a machine frame 11 having an operator's platform 12. On operator's platform 12, the machine operator can drive the road milling machine and can control functions of the road milling machine.

Machine frame 11 is carried by a propelling unit 13. Propelling unit 13 encompasses, for example, four crawler track units 14 that are arranged at the front and rear end on both sides of machine frame 11. Crawler track units 14 enable the road milling machine to move forward and backward along a travel path. Lifting columns 15 are provided in order to adjust the height of machine frame 11 with respect to propelling unit 13. Crawler drive units 14 on the one hand, and machine frame 11 on the other hand, are fastened onto these lifting columns 15. By adjusting lifting columns 15, the machine operator can perform a vertical alignment of machine frame 11 with respect to a roadway.

Wheels can also be provided instead of a crawler track unit 14.

The road milling machine possesses a working unit, which is a milling device having a milling drum 30. Milling drum 30 is populated with working tools 31. The milling drum 30 may also be referred to as a working drum 30.

Working tools 31 are fastened replaceably on milling drum 30 through the intermediary of retaining arrangements, for example bit holders or quick-change bit holder systems.

As FIG. 1 shows, milling drum 30 is arranged on machine frame 11 between the front and rear crawler track units 14. The invention is of course not limited to utilization in the context of such types of machine, usually referred to as "large" milling machines. It is instead also conceivable for milling drum 30 to be arranged between the rear propelling units. Such machine types are usually referred to as "compact" or "small" milling machines. The roadway surface is milled off with milling drum 30. In order to drive milling drum 30, the road milling machine comprises a drive unit 20 that is also carried by machine frame 11. Drive unit 20 is depicted schematically, and drawn with dashed lines, in FIG. 1.

Drive unit 20 drives not only milling drum 30 but also crawler track units 14 and further units of the road milling machine, which include e.g. lifting columns 15 for adjusting machine frame 11, or positioning drives (not depicted) for steering, or a water pump (not depicted) for cooling working tools 31 of milling drum 30.

Figure 2:
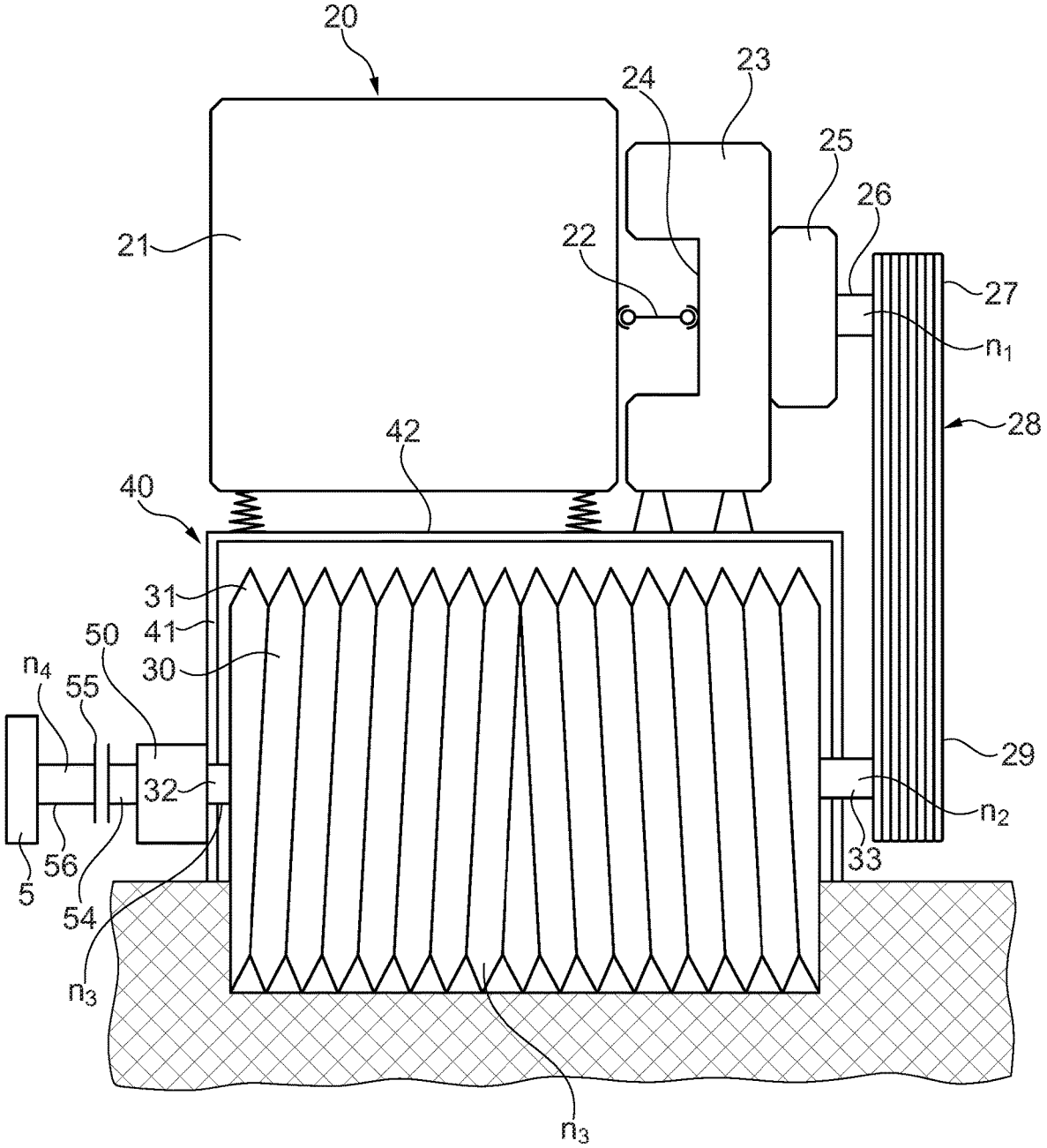
FIG. 2 schematically depicts a milling unit of the earth working machine according to FIG. 1.

FIG. 2 schematically depicts drive unit 20. This drawing once again shows milling drum 30, specifically in a view from the left transversely to the direction of travel, perpendicularly to the image plane in accordance with FIG. 1. Working tools 31 are depicted schematically in this view. As the illustration further shows, milling drum 30 is arranged in a milling drum housing 40. Milling drum housing 40 possesses side walls 41 and a top panel 42. Side walls 41 and top panel 42 shield milling drum 30 with respect to the environment. An opening is usually provided on milling drum housing 40, through which material can travel onto a conveying apparatus (not depicted), for example made up of conveyor belts, in order to load the material, for instance, onto a truck.

Milling drum 30 is mounted rotatably on machine frame 11 or on milling drum housing 40. Milling drum 30 possesses an input drive shaft 33 and a bearing shaft 32.

Milling drum 30 can be driven with drive unit 20. Specifically, drive unit 20 encompasses a drive motor 21 that is usually constituted by an internal combustion engine. Drive motor 21 is connected via a coupling element 22 to a pump distribution transmission 23. For a space-saving design, coupling element 22 can be arranged at least locally in a cavity 24 of the pump distribution transmission. In the pump distribution transmission, a fluid becomes pressurized. That fluid is guided via pressure conduits to individual functional units of the road milling machine, for example lifting columns 15, or to hydraulic motors of crawler track unit 14. A shifting device 25 is provided downstream from pump distribution transmission 23.

Drive motor 21 can be selectably coupled to or decoupled from a shaft 26 by means of shifting device 25.

Shaft 26 carries a belt pulley 27 that is part of a transfer unit 28. Transfer unit 28 also encompasses a further belt pulley 29. The two belt pulleys 27, 29 are connected to one another by an endlessly circulating belt drive.

As FIG. 2 illustrates, belt pulley 29 is retained on input drive shaft 33 of the milling drum. Input drive shaft 33 is guided through a lateral opening in the associated side wall 41 of milling drum housing 40. Input drive shaft 33 is coupled indirectly or directly onto milling drum 30. A bearing shaft 32 is provided concentrically with input drive shaft 33 on the oppositely located side of milling drum 30. Input drive shaft 33 and bearing shaft 32 together form the rotation axis for milling drum 30.

FIG. 2 further illustrates the fact that a conversion transmission 50 is arranged outside the milling drum housing. This conversion transmission 50 can be designed as a transmission having one or several transmission ratio steps, or as a steplessly operating transmission. Bearing shaft 32 leads directly to the input side of conversion transmission 50. A connecting piece 54 in the form of a shaft, constituting a rotational member, is arranged on the output drive side of conversion transmission 50. Connecting piece 54 creates the connection to a coupling 55, which here is a shiftable coupling 55. Shiftable coupling 55 can be operated from operator's platform 12. It is also conceivable for a separately actuatable shifting unit, for operating coupling 55, to be provided in the vicinity of milling drum housing 40. Preferably, however, shiftable coupling 55 is to be operated from operator's platform 12, offering considerably simplified operation.

Coupling 55 is connected via a supporting shaft 56 to a kinetic mass 57. Kinetic mass 57 is a weight that is attached to supporting shaft 56. It is also conceivable for kinetic mass 57 to be exchangeably coupled, indirectly or directly, to supporting shaft 56.

Figure 3:
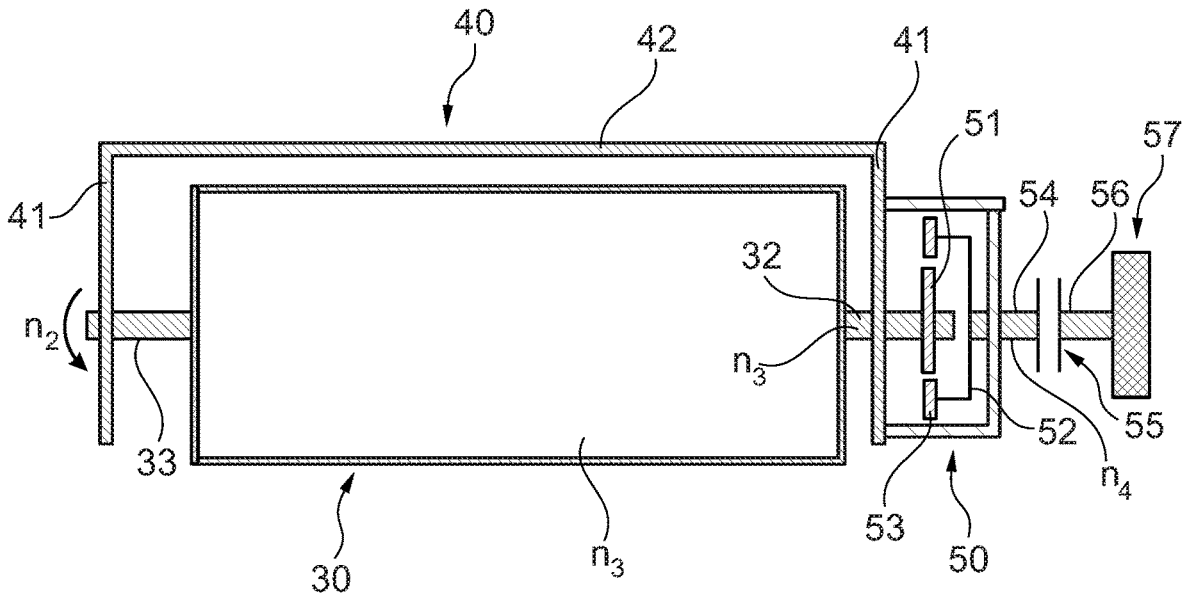
FIG. 3 schematically depicts a milling drum housing having a milling drum received therein.

The configuration depicted in FIG. 2 is illustrated once again in more detailed fashion in FIG. 3, the view selected here being one in which milling drum 32 is depicted from the opposite side.

As FIG. 3 shows, conversion transmission 50 is fastened externally onto the associated side wall 41.

Conversion transmission 50 can be embodied, for example, as a planetary transmission, a driving element 51, which constitutes the sun gear of the planetary transmission, being retained on bearing shaft 32. In addition, a planet carrier 52 having an output drive element 53 (planet gears) is retained nonrotatably on connecting piece 54. As FIG. 3 illustrates, planet carrier 52 carries gears that mesh with the sun gear. The invention is, of course, not limited to the use of a planetary transmission as conversion transmission 50. It is instead also conceivable for other forms of transmission to be used.

The manner of operation of the arrangement shown in FIGS. 2 and 3 is as follows: Drive motor 21 drives pump distributor transmission 23 via coupling element 22. When shifting device 25 is engaged, shaft 26 is connected to drive motor 21. Transfer unit 28 is thereby driven at a rotation speed n2 that can correspond to rotation speed n1 of drive motor 21. On the output drive side of transfer unit 28, rotation speed n2 is present at input drive shaft 33. In large milling machines, rotation speed n1 corresponds approximately to rotation speed n2, although a different conversion ratio can of course also be selected. That rotation speed n2 is then stepped down, by means of a milling transmission (not depicted in the drawing), to a lower rotation speed n3 at which milling drum 30 rotates. In ordinary road milling machines, this conversion ratio between the higher rotation speed n2 and the milling drum rotation speed n3 is in the range between 10 and 30.

The same rotation speed n3 at which milling drum 30 is rotating is also present at bearing shaft 32. Rotation speed n3 accordingly also feeds into the input drive side of conversion transmission 50, as shown in FIG. 3.

Conversion transmission 50 then converts rotation speed n3 to a higher rotation speed n4 that is present at connecting piece 54. When coupling 55 is closed, this rotation speed n4 is also present at supporting shaft 56, so that kinetic mass 57 rotates at the higher rotation speed n4.

When coupling 55 is closed, kinetic mass 57 can consequently be coupled to milling drum 30 via coupling 55 and conversion transmission 50. The rotational energy generated during the rotary motion of kinetic mass 57 is introduced into milling drum 30, thereby increasing the kinetic energy of milling drum 30. The result is that milling drum 30 runs more smoothly.

Figure 4:
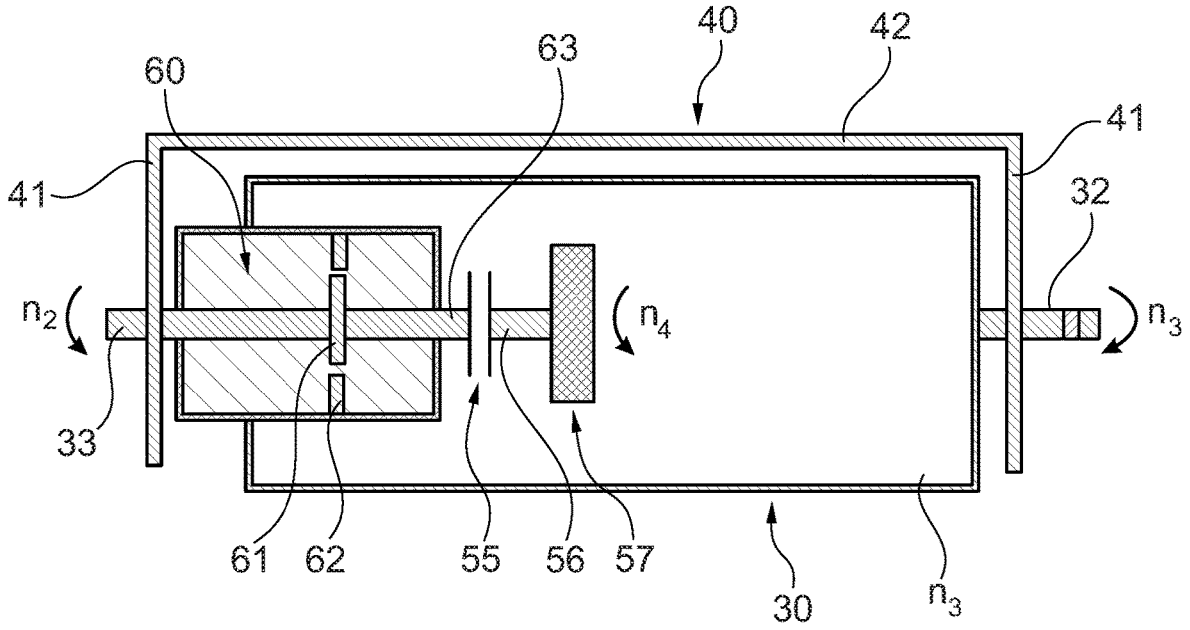
FIG. 4 schematically depicts a milling drum housing having a milling drum received therein, as an alternative to the embodiment in accordance with FIG. 3.

FIG. 4 depicts an alternative variant embodiment of the invention. As this drawing illustrates, milling drum 30 is once again accommodated in milling drum housing 40. Input drive shaft 33 and bearing shaft 32 are once again coupled rotatably onto machine frame 11 or onto milling drum housing 40. A milling transmission 60 is accommodated in the space surrounded by milling drum 30. As has been explained above, rotation speed n2 of belt pulley 29 can be stepped down by this milling transmission 60. Milling transmission 60 can be embodied as a planetary transmission. It possesses a driving element 61, usually a gear, that is nonrotatably connected to input drive shaft 33. One or several gears 62 (planet gears) mesh with this driving element 61 in order to achieve a stepdown in rotation speed. This stepped-down rotation speed then corresponds to rotation speed n3 of milling drum 30. Input drive shaft 33 has a connecting piece 63 that is attached via a coupling 55 to a supporting shaft 56. Supporting shaft 56 carries kinetic mass 57. Rotation speed n4 at which kinetic mass 57 rotates accordingly corresponds to rotation speed n2 of input drive shaft 33 when coupling 55 is closed. It is also conceivable to provide a conversion transmission 50 that is arranged before or after coupling 55 and that steps rotation speed n2 of drive shaft 33 up to a higher rotation speed n4 at which kinetic mass 57 rotates.

As is evident from FIG. 4, kinetic mass 57 and coupling 55 are arranged in protected fashion inside the installation space surrounded by milling drum 30. Milling transmission 60 is also arranged locally inside milling drum housing 40, and partly inside the installation space surrounded by milling drum 30.

In the exemplifying embodiments described above, the axis around which kinetic mass 57 rotates aligns with the rotation axis of milling drum 30. It is also conceivable, however, for these two rotation axes to be arranged parallel to one another at a distance. It is furthermore conceivable for these rotation axes to proceed at an angle to one another.

The invention claimed is:

1. An earth working machine, comprising:

a machine frame;

a working drum rotatably mounted relative to the machine frame, the working drum including working tools configured to contact a ground surface to work the ground surface;

a drive motor;

an input drive shaft connected to the working drum, the input drive shaft being configured to be coupled to the drive motor so that the drive motor drives the working drum;

a kinetic mass; and a shiftable coupling configured to couple the kinetic mass to the working drum to increase a kinetic energy of the working drum and to decouple the kinetic mass from the working drum.

2. The earth working machine of claim 1, wherein:

the working drum rotates at a speed in a range of from 30 to 240 revolutions per minute; and the kinetic mass rotates at a speed in a range of from 60 to 4000 revolutions per minute.

3. The earth working machine of claim 1, wherein:

the working drum has a moment of inertia having a first value when the shiftable coupling is disengaged to decouple the kinetic mass from the working drum, and the working drum and the kinetic mass together have a moment of inertia having a second value when the shiftable coupling is engaged to couple the kinetic mass to the working drum, the second value being at least twice as great as the first value.

4. The earth working machine of claim 1, wherein:

a moment of inertia of the kinetic mass is greater than or equal to $T/i^2$, where T corresponds to a moment of inertia of the working drum and i is a rotation speed ratio between a rotation speed of the kinetic mass and a rotation speed of the working drum.

5. The earth working machine of claim 1, further comprising:

a conversion transmission connected between the kinetic mass and the working drum, the conversion transmission being configured to convert a rotation speed of the working drum to a higher rotation speed of the kinetic mass, the conversion transmission having a conversion ratio modifiable in at least two ratio steps or steplessly.

6. The earth working machine of claim 1, further comprising:

a conversion transmission connected between the kinetic mass and the working drum, the conversion transmission being configured to convert a rotation speed of the working drum to a higher rotation speed of the kinetic mass; and wherein the working drum encloses an installation space, and the conversion transmission is located at least partially in the installation space.

7. The earth working machine of claim 1, further comprising:

a conversion transmission connected between the kinetic mass and the working drum, the conversion transmission being configured to convert a rotation speed of the working drum to a higher rotation speed of the kinetic mass;

a working drum housing attached to the machine frame; and wherein the conversion transmission is located at least partially inside the working drum housing.

8. The earth working machine of claim 1, wherein:

when the shiftable coupling is engaged the working drum is coupled to the kinetic mass such that a rotation speed of the working drum and a rotation speed of the kinetic mass are equal to one another, slippage of the shiftable coupling being disregarded.

9. The earth working machine of claim 1, wherein:

wherein the working drum encloses an installation space; and the shiftable coupling and the kinetic mass are arranged inside the installation space surrounded by the working drum.

10. The earth working machine of claim 1, wherein:

the kinetic mass is exchangeable.

11. The earth working machine of claim 1, further comprising:

a bearing shaft disposed on an opposite end of the working drum from the input drive shaft, the working drum being rotatably mounted relative to the machine frame on the bearing shaft;

wherein the shiftable coupling is connected to one of the input drive shaft and the bearing shaft.

12. The earth working machine of claim 1, further comprising:

a conversion transmission connected between the kinetic mass and the working drum, the conversion transmission being configured to convert a rotation speed of the working drum to a higher rotation speed of the kinetic mass.

13. The earth working machine of claim 12, further comprising:

a bearing shaft disposed on an opposite end of the working drum from the input drive shaft, the working drum being rotatably mounted relative to the machine frame on the bearing shaft; and wherein the conversion transmission includes an input drive side connected to one of the input drive shaft and the bearing shaft.

14. The earth working machine of claim 13, wherein:

the conversion transmission includes an output drive side, and the shiftable coupling is connected between the output drive side of the conversion transmission and the kinetic mass.

15. The earth working machine of claim 1, further comprising:

a conversion transmission connected between the kinetic mass and the working drum, the conversion transmission being configured to convert a rotation speed of the working drum to a higher rotation speed of the kinetic mass;

a working drum housing attached to the machine frame, the working drum housing defining an internal space, the working drum being received at least partially in the internal space of the working drum housing; and wherein the conversion transmission is arranged on the working drum housing outside of the internal space.

16. The earth working machine of claim 15, wherein:

the conversion transmission is mounted on a side wall of the working drum housing.

17. The earth working machine of claim 1, wherein:

when the shiftable coupling is engaged the working drum is coupled to the kinetic mass such that a rotation speed of the working drum and a rotation speed of the kinetic mass deviate from one another.

18. The earth working machine of claim 17, further comprising:

a conversion transmission connected between the working drum and the kinetic mass, the conversion transmission providing the deviation between the rotation speed of the working drum and the rotation speed of the kinetic mass.

19. The earth working machine of claim 1, further comprising:

a milling transmission;

wherein the working drum encloses an installation space, and the milling transmission is located at least partially in the installation space; and wherein the input drive shaft is received in the milling transmission.

20. The earth working machine of claim 19, wherein:

the milling transmission comprises a planetary transmission including a sun gear on a sun gear shaft; and the shiftable coupling is configured to couple the kinetic mass to the sun gear shaft.

21. The earth working machine of claim 1, further comprising:

an endlessly circulating belt drive connecting the drive motor to the input drive shaft.

22. The earth working machine of claim 21, further comprising:

a pump distribution transmission driven by the drive motor and located between the drive motor and the endlessly circulating belt drive.

* * * * *